United States Patent [19]

Kawahara

[11] Patent Number: 4,703,710

[45] Date of Patent: Nov. 3, 1987

[54] DECK STRUCTURE OF WATERCRAFT

[75] Inventor: Masahiro Kawahara, Kobe, Japan

[73] Assignee: Kawasaki Jukogyo Kabushiki Kaisha, Hyogo, Japan

[21] Appl. No.: 858,652

[22] Filed: May 2, 1986

[30] Foreign Application Priority Data

May 13, 1985 [JP] Japan ..... 60-100840

[51] Int. Cl.[4] ..... B63B 17/00

[52] U.S. Cl. ..... 114/364; 114/273; 114/361; 114/363

[58] Field of Search ..... 114/364, 363, 343, 361, 114/218, 85, 271–273, 267, 270; 440/38–43

[56] References Cited

U.S. PATENT DOCUMENTS

| | | | |
|---|---|---|---|
| 804,154 | 11/1905 | Morse | 114/364 |
| 2,817,859 | 12/1957 | McCarthy | 114/364 |
| 3,862,456 | 1/1975 | Fisher | 114/364 |
| 3,926,136 | 12/1975 | Shroyer | 114/364 |
| 4,185,346 | 1/1980 | Adrian | 114/364 |
| 4,357,894 | 11/1982 | Kirk | 114/363 |
| 4,442,787 | 4/1984 | Curran | 114/363 |
| 4,582,015 | 4/1986 | Hunter | 114/364 |

*Primary Examiner*—Joseph F. Peters, Jr.
*Assistant Examiner*—Clifford T. Bartz

[57] ABSTRACT

A deck structure adapted for a watercraft in which the rider rides on the rear deck to steer gripping the handles. Side fences with a riding floor formed between them are disposed so as to be adjustable in the transverse directional position of the hull. Further, with another arrangement, the side fences and a saddle-type seat placed on the center line of the hull are removable, and either or both of them can be fixed on the deck for steering in a desirable posture.

1 Claim, 11 Drawing Figures

DECK STRUCTURE OF WATERCRAFT

FIELD OF THE INVENTION AND RELATED ART STATEMENT

This invention relates to a deck structure of a watercraft so designed that the rider on the rear deck can steer gripping the handles with his hands.

In general, a high speed watercraft (typically racing at 27 knots) with an excellent maneuverability has the engine in the engine room occupying the fore section of the hull and the impeller at the rear bottom of the hull, allowing the rider to ride on the rear deck at the back of the engine room and steer with his hands gripping the handles mounted on the hull.

Either propellers or water jet pumps are employed as propulsion machinery. In the case of the water jet pump, steering is made through changing the direction of the water jet.

As the deck structure, the following typical structures have been employed: The structure consisting of fin-like side fences extending at either sides of the rear deck and the riding floor between the fences on which the rider mostly takes a standing position; or the other (suitable for tandem ride) consisting of the saddle-shape seat extending upward at the center and the steps at either sides of the seat for the rider to straddle on the seat.

But, since the side fences or the seat according to the conventional deck structure is not flexible, adjustment in accordance with the physiques or likings of riders has been impossible.

Therefore, with the deck structure having the side fences on both sides thereof, the riding floor is too narrow for a well-built rider, or inconvenient for the rider to take a horse-back position for steering or for tandem ride because of lack of a seat.

OBJECT AND SUMMARY OF THE INVENTION

The object of the invention is to provide a deck structure for a watercraft which can eliminate aforesaid drawbacks of the prior art to give an appropriate width of the riding floor adjustable according to the physiques or the likings of riders, and further to allow him to assume either a standing or horse-back position.

To achieve the first object above mentioned, the first invention has fin-shaped side fences extending upward at either sides of the rear deck and a riding floor formed therebetween, and, with the deck structure for a watercraft where the rider rides on aforesaid riding floor for steering, aforesaid side fences are so mounted as to adjust their position in the transverse direction with respect to the hull.

And further to achieve the second object, the second invention has removable fin-shaped side fences at either sides of the rear deck and a removable saddle-type seat on the center line of the rear deck, with the deck structure for a small watercraft where the rider rides on the rear deck for steering.

BRIEF DESCRIPTION OF THE DRAWING

In the accompanying drawings, there are shown illustrative embodiments of the invention from which these and other of its objectives, novel features and advantages will be readily apparent.

In the drawings.

DETAILED DESCRIPTION OF THE PREFERRED EMBODIMENT

The following drawings depict in detail preferred embodiments according to the invention adapted for a watercraft.

Figure 1:
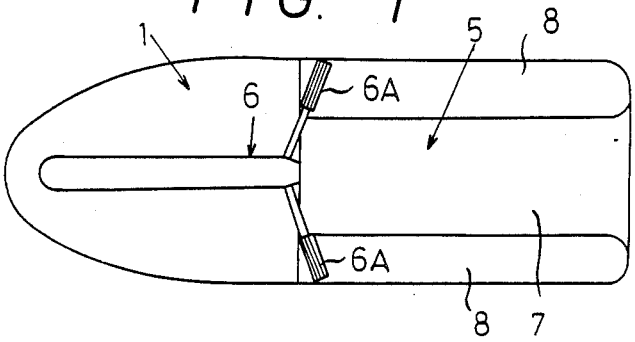
FIG.1 is a plan view of a watercraft having a deck structure in accordance with an embodiment of the invention.
Figure 2:
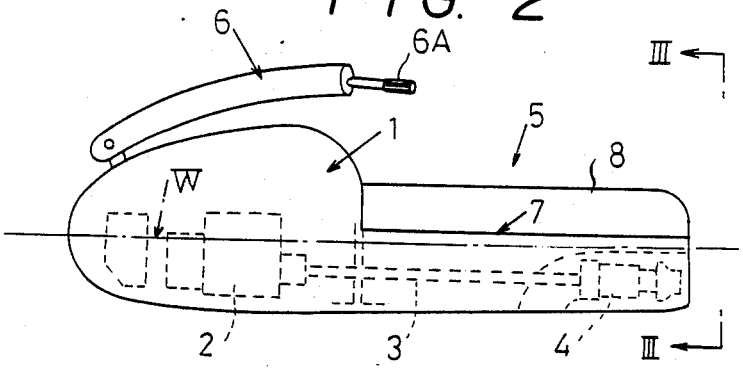
FIG.2 is a side view of the watercraft in FIG. 1.
Figure 3:
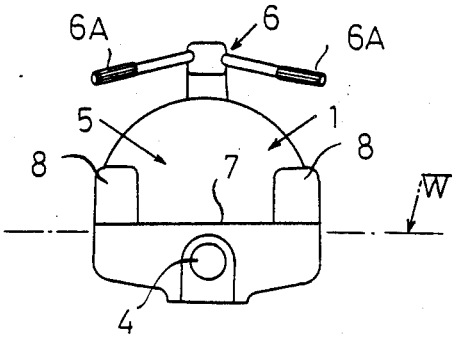
FIG. 3 is a rear view taken from the line III—III of FIG. 2.

In FIGS. 1 to 3, an engine 2 installed in an engine room 1 situated at the fore section of the hull drives a propeller 4 disposed at the bottom rear hull through a driving shaft 3.

The deck forming the upper half portion of a watercraft and the hull composing the lower half thereof are usually made of plastic moldings (such as fiber glass reinforced plastics ).

A rear deck 5 at the back of the engine room 1 is a portion where the rider rides on to steer with his hands gripping handles 6 (more particularly grips 6A and 6A) mounted at the fore section of the hull.

The rear deck 5 is provided with a pair of fin-shaped side fences protruding upward at either sides of a deck floor 7. These side fences 8 are mounted so that they can be adjusted in the transverse directional position relative to the center line of the deck floor 7.

Moreover, where necessary, each of aforesaid side fences 8 and 8 can be mounted so as to be removed from the deck floor 7, or to be removable from the deck floor 7 and reattached thereto in a different transverse directional position relative to the hull.

When aforesaid side fences 8 and 8 are mounted removably, a removable saddle-type seat separately made can be mounted in place of the side fences 8 and 8, at the center of the deck floor 7.

Figure 4:
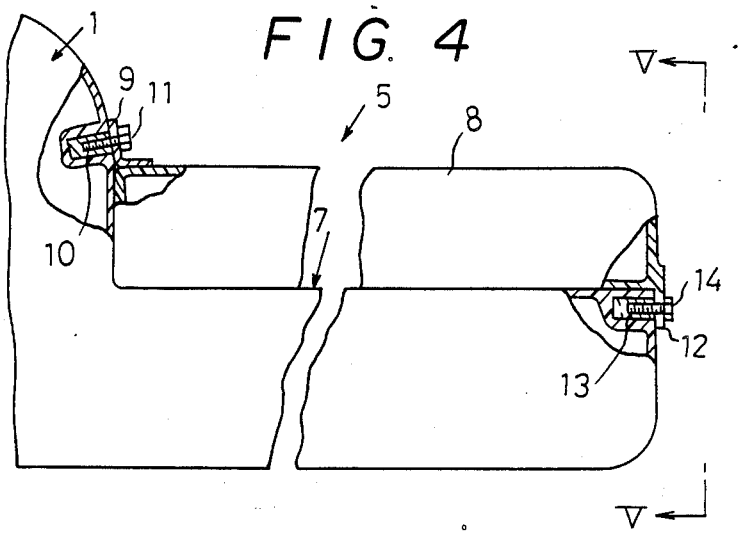
FIG. 4 is a partially cutaway side view of the deck structure in accordance with the embodiment of the invention.
Figure 5:
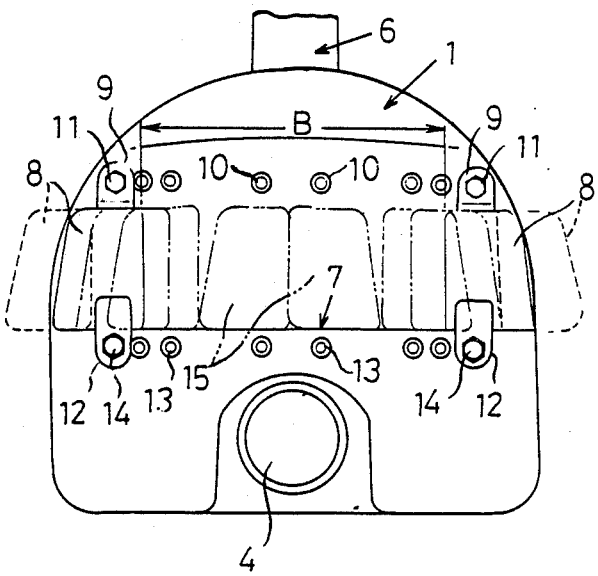
FIG. 5 is a rear view taken from the line V—V of FIG. 4.

FIGS. 4 and 5 are a partially cutaway view and a rear view exemplifying a fitting construction of a pair of the side fences 8 and 8 on the deck floor 7 adjustable in their transverse directional position relative to the hull.

In FIGS. 4 and 5, each of the side fences 8 and 8 is secured on the floor deck 7 by removably connecting its front and rear ends respectively to the rear face of the engine room 1, and the transom.

More particularly, each of the side fences 8 and 8 is fixed to the deck by connecting a front lug 9 of the side fence 8 with a tapped hole 10 in the back wall of the engine room 1 and a bolt 11 as well as a rear lug 12 thereof with a tapped hole 13 in the transom and a bolt 14.

As shown in FIG. 5, more than one pair of each of said tapped holes 10 and 13 are drilled symmetrically with respect to the center line of the hull. A distance B between the side fences 8 and 8 can be altered in a stepwise fashion as indicated by the two-dot chain lines, by choosing two proper pairs of the tapped holes 10 and 13 to which the side fences 8 and 8 are fastened.

On the embodiment given in FIGS. 4 and 5, a distance B between the side fences 8 and 8 almost comes to zero as they are disposed back to back using the innermost pairs of the tapped holes 10 and 13, providing a seat 15 like a saddle at the center line of the deck floor 7. When the saddle-type seat 15 is formed, the deck floor 7 extending sideward to both the right and left beyond the formed seat 15 provides the rider with steps which serve as footrests.

According to the embodiment of FIGS. 4 and 5, since the side fences 8 and 8 can be fitted to either sides of the deck 7 adjustably in the transverse directional positions of the hull, the rider can adjust the width of the riding floor (open deck floor 7) formed between the side fences 8 and 8 depending on his physique and liking.

Furthermore, the saddle-type seat 15, which takes shape when the side fences 8 and 8 are brought back to back close to each other, enables not only the rider to take a horse-back riding position but also two riders to assume a comfortable posture. And, by having the side fences 8 and 8 hung over beyond the deck sides as shown by the two-dot chain lines in FIG. 5, a spacious room of riding floor can be secured as to accomodate luggages or other like thereon.

Figure 6:
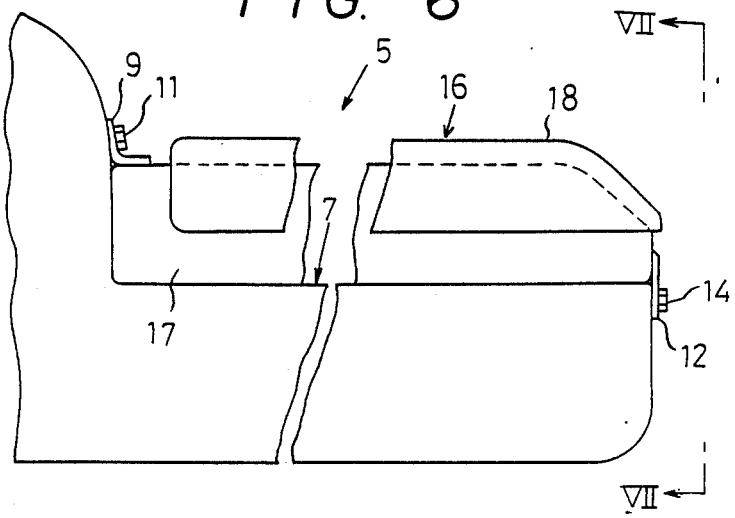
FIG. 6 is a side view of a deck structure in accordance with another embodiment of the invention.
Figure 7:
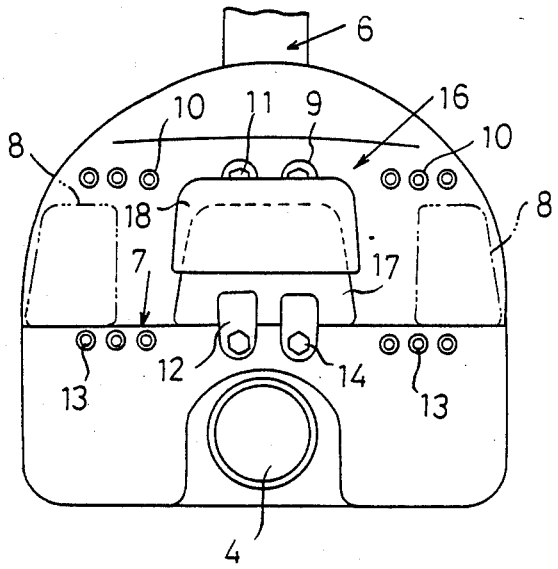
FIG. 7 is a rear view taken from the line VII—VII of FIG. 6.

FIGS. 6 and 7 are side and rear views of another embodiment according to the invention in which an exclusive-use removable saddle-type seat 16 is used on said deck floor 7 in addition to the deck construction shown in FIGS. 4 and 5.

Said saddle-type seat 16 is removably secured using the innermost of the plural pairs of the tapped holes 10 and 13. Since the method of fastening said saddle-type seat 16 is similar to that in FIGS. 4 and 5, the like reference numerals are provided for the like parts as those in FIGS. 4 and 5, thus a further explanation being eliminated.

With the aim to make the rider comfortable, the saddle-type seat 16 shown in Figs.6 and 7 consists of a box (or frame) 17 made of plastic moldings and a cushion 18 over it.

According to the embodiment, the mounting of the saddle-type seat 16 in place of a pair of the side fences 8 and 8 can provide for a desirable deck structure not only for the rider to take a horse-back riding position for steering but also for two riders to sit on together, while the replacement of the side fences 8 and 8 in place of the saddle-type seat 16 results in a favorable riding floor-type deck structure for lateral stability and breakwater capability and for the rider to operate standing thereon.

Since a deck structure according to the second embodiment is the same as that of FIGS. 4 and 5, a width of the riding floor or an open space of the deck floor 7 between said side fences 8 and 8, can be adjustable according to the physique and liking of the rider, and further the seat (indicated by the two-dot chain lines 15 in FIG. 5) can be formed only said side fences 8 and 8 brought back to back, without using the saddle-type seat 16.

And, when both the side fences 8 and 8 and the seat 16 are used at the same time, a deck structure not only superior in lateral stability and breakwater capability but also appropriate for the rider to manoeuvre in a horse-back riding position. In this case, it is preferable to have a ship width large enough for sufficient footrest.

Figure 8:
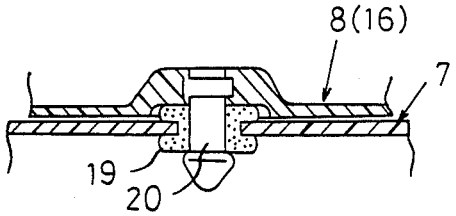
FIG. 8 is a segmentary vertical sectional view illustrating another fitting construction of the side fences or the seat.
Figure 9:
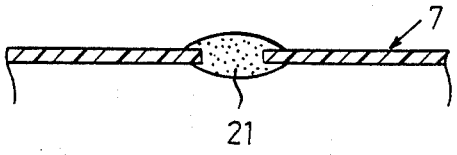
FIG. 9 is a sectional view showing a plug for sealing an opening in the deck.

Figs.8 and 9 are segmentary vertical sectional views showing another mounting mechanism (indicating only one place), when respectively in use and out of use, through which said side fences 8 and 8 or said saddle-type seat 16 is fixed on the deck floor 7.

With the mounting mechanism as shown in FIG. 8, rather than the fastening method in accordance with each embodiment mentioned earlier by using the tapper holes 10 and 13 (FIGS. 4,5 and 7) and the bolts 11 and 14 (FIGS. 4,5,6 and 7), removable grommets 19 of rubber or soft plastics are watertight fitted into the openings in the deck 7, and, in turn, through the holes at the center of the grommets 19, top-expanded lugs 20 studded in the bottom of the side fences 8 and 8 or the saddle-type seat 16 are fitted so that they can be freely removed.

The number of said lugs 20 planted in the bottom of the side fences 8 and 8 or the saddle-type seat 16 is determined as necessary (say two to four).

On the other hand, the openings in the deck 7 for accepting the grommets 19 must be arranged by considering the positional adjustment of the side fences 8 and 8 in the transverse direction and the installation of the saddle-type seat 16 namely the location, number and positional adjustment of said lugs 20.

It is preferable to prevent the water from flowing into through the deck 7, by replacing said grommets 19 (FIG. 8) with removable blind plugs 21 made of rubber or other like as shown in FIG. 9 where grommets are out of use.

And, some well-known fixing means such as buckles may be used for installing the side fences and the saddle-type seat on the hull, instead of the means already disclosed.

Figure 10:
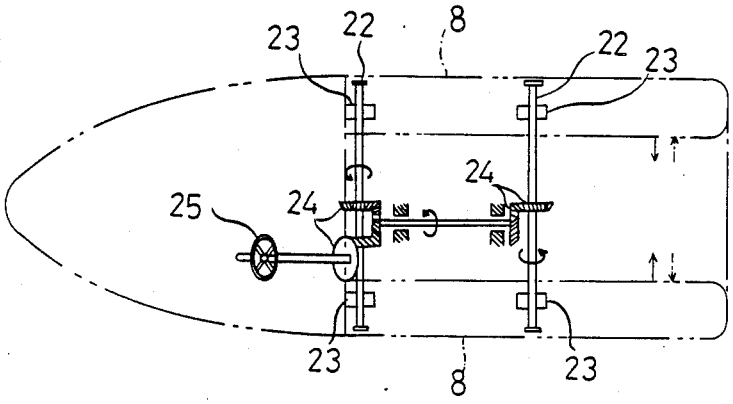
FIGS. 10 and 11 are respectively a plan view and a side view of a device steplessly adjusting the position of the side fences.
Figure 11:
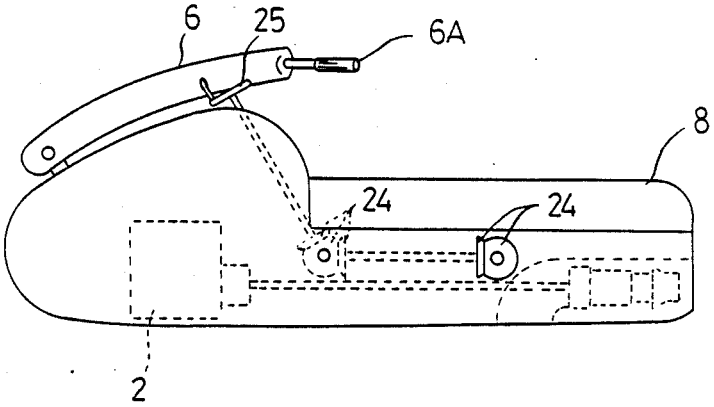

Besides the embodiments explained above, as shown in Figs.10 and 11, as means for adjusting the transverse position of said side fences 8 and 8, screw shafts 22 having a right-handed screw or a left-handed screw on each end may be supported by bearings across the deck 7 at the fore and aft sections of the hull to engage the left side fence 8 and the right side fence 8 or their protrusions 23 respectively with the left-handed threads or the right-handed threads, so that turning said screw shafts 22 causes said side fences 8 and 8 to come nearer to each other or be removed from each other. This mechanism enables a distance between the side fences 8 and 8 to be continuously adjusted. The screw shafts 22 can be power-driven rather than manual-driven.

As apparent from the description above, the first invention can provide a deck structure adapted for a watercraft in which a width of said riding floor is easily adjusted according to the physique and liking of the rider, in the provision of the said side fences extending upward on either sides of the deck with the riding floor formed between them.

Further, the second invention can provide a deck structure for a watercraft in which convertible are a deck having said riding floor and a deck with the saddle-type seat suitable for steering with the rider sitting thereon.

What is claimed is:

1. A deck structure for a watercraft having an elongated hull, comprising: a riding floor at a rear portion of said deck structure above said hull, and fin-shaped side fences extending upwardly from said riding floor; said side fences being translatably movable in a direction transverse to the longitudinal extension of the hull between a position adjacent to sides of the hull, and a position essentially in the center of the rear portion so as to form a seat.

* * * * *